US005848534A

United States Patent [19]

Stauffer

[11] Patent Number: 5,848,534

[45] Date of Patent: Dec. 15, 1998

[54] WINE BOTTLE REFRIGERATOR WITH ENCLOSED CIGAR HUMIDOR DRAWER

[75] Inventor: Gordon L. Stauffer, Greenville, Mich.

[73] Assignee: Northland Corporation, Richmond, Ind.

[21] Appl. No.: 917,969

[22] Filed: Aug. 27, 1997

[51] Int. Cl.[6] ..... A47F 3/04

[52] U.S. Cl. ..... 62/91; 62/249; 312/31.01; 312/311; 312/404

[58] Field of Search ..... 62/93, 94, 91, 62/246, 249, 252; 312/31.01, 31.03, 31.04, 311, 404, 408

[56] References Cited

U.S. PATENT DOCUMENTS

| | | | |
|---|---|---|---|
| 4,838,911 | 6/1989 | Robertson et al. | 62/93 |
| 4,898,294 | 2/1990 | Jennings | 312/311 |
| 5,312,744 | 5/1994 | Shibata | 435/174 |
| 5,607,051 | 3/1997 | Espompsa | 206/213.1 |
| 5,641,217 | 6/1997 | Caruso et al. | 312/404 |

*Primary Examiner*—William E. Tapolcai
*Attorney, Agent, or Firm*—Jacox, Meckstroth & Jenkins

[57] ABSTRACT

A wine bottle refrigerator has a pivotal front access door for a cooling chamber enclosing racks supporting bottles of wine, and an upper portion of the chamber encloses a wood cigar humidor supported by a drawer for movement between a retracted storage position within the chamber and an extended access position after the door is open. The humidor encloses a humidifier to maintain the cigars at generally a predetermined relative humidity, and the wine bottle refrigerator maintains the temperature of the bottles of wine and the humidor at a dependable and substantially constant predetermined temperature and relative humidity. In one embodiment, a removable humidor is supported by an extendable drawer, and in another embodiment, the extendable drawer forms part of the humidor.

12 Claims, 3 Drawing Sheets

28
25
26
72
58
68
71
56
58
44
48
47
72
71
56
68
48
40
52
42
76
64
66
64
12
74
66
64
62
60
66

WINE BOTTLE REFRIGERATOR WITH ENCLOSED CIGAR HUMIDOR DRAWER

BACKGROUND OF THE INVENTION

The present invention relates to a cigar humidor of the general type disclosed in U.S. Pat. No. 5,607,051. Such humidors are commonly constructed in the form of a wood box having a hinged lid or closure, and preferably the interior or liner of the box is constructed of Spanish cedar to provide a desired environment for storing the cigars. Usually, the humidor lid supports or carries a humidifier for maintaining the enclosed humidor chamber at a predetermined relative humidity, preferably about 70%. If the humidity goes above 75% the tobacco develops mold, and if the humidity goes below 65%, the cigars dry out. One such humidifier which is used to provide generally a 70% relative humidity is manufactured by a French company and sold under the trademark CREDO. This humidifier uses distilled water mixed with a solution of polycyclone.

It is also important to store a supply of cigars within a cigar humidor within a predetermined temperature range, preferably above 50° F. and below 75° F. If the temperature goes above 75° F., the tobacco beetle larva becomes active. If the temperature goes below 50° F., aging of the cigars slows substantially. If a wood humidor is precisely constructed so that the lid or closure forms a tight seal with the humidor box, and the humidor is stored in the proper environment, the enclosed humidifier can maintain the 70% relative humidity within the enclosed humidor chamber confining the cigars. However, the more frequent a humidor is opened within a room within the desired temperature range, but having a substantially lower or higher relative humidity, the more difficult it is for the humidifier to maintain the cigars within the humidor at a 70% relative humidity.

SUMMARY OF THE INVENTION

The present invention is directed to a wine bottle refrigerator which also encloses a cigar humidor and supports the humidor for convenient access when it is desired to remove one or more cigars. The wine bottle refrigerator and humidor system of the invention is also effective to store a supply of cigars at a substantially constant temperature within the desired range and at a substantially constant relative humidity of about 70% in order to preserve the cigars and extend their useful life.

In accordance with the preferred embodiments of the invention, a wine bottle refrigerator includes a cabinet having a front access door and defining a chamber which receives a series of racks for storing bottles of wine, and the refrigerator maintains the chamber at a thermostatically controlled temperature generally within a range between the upper forties to the lower sixties and at a relative humidity of about 50%. A wood cigar humidor is supported within an upper portion of the chamber by means of an extendable drawer which moves the humidor or a portion of the humidor between a retracted stored position within the refrigerator chamber and an extended position after the cabinet door is open to provide convenient access to the cigars stored within the humidor. In one form, a removable wood humidor, with an enclosed humidifier, is supported within an upper portion of the refrigerator by an extendable drawer, and in another form, an extendable wood drawer forms a portion of the humidor, and a box portion of the humidor and the humidifier remain within the cabinet when the drawer is extended to present a supply of cigars.

Other features and advantages of the invention will be apparent from the following description, the accompanying drawings and the appended claims.

DESCRIPTION OF THE PREFERRED EMBODIMENTS

Figure 1:
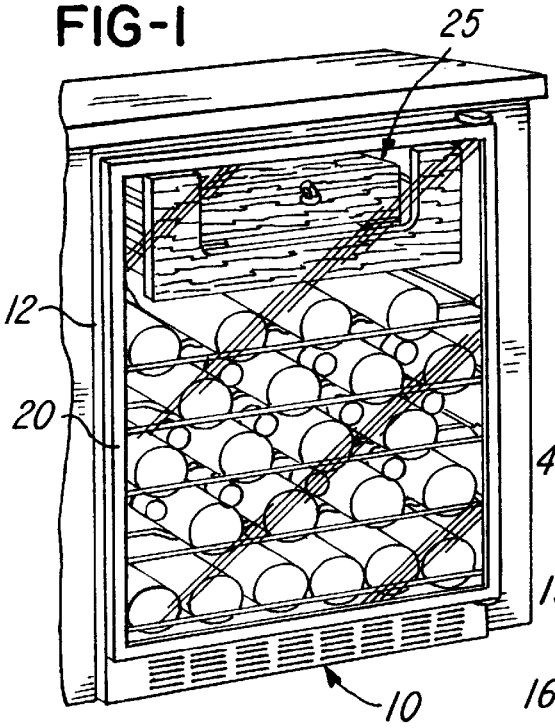
FIG. 1 is a perspective view of a wine bottle refrigerator incorporating an extendable drawer supporting a cigar humidor in accordance with the invention.

FIG. 1 illustrates an undercounter wine bottle refrigerator 10 which includes a cabinet 12 defining generally a box-like cooling chamber 14. A set of wire racks 16 are positioned within the chamber 14 for supporting a supply of bottles 18 filled with wine. The chamber 14 is normally closed by a closure or door 20 which pivots between a closed position (FIG. 1) and an open position (FIG. 2) to provide access to the wine bottles 18. The refrigerator 10, including the cabinet 12 and rack 16, is commercially available, for example, as the Model 61WC manufactured by Marvel Industries, a division of Northland Corporation, the assignee of the present invention.

In accordance with the present invention, a wood cigar humidor 25 (FIGS. 1–4) includes a wood box 26 having a pivotally supported wood closure or lid 28 to define a chamber or compartment for receiving a supply of cigars C. Preferably the box 26 and the lid 28 are constructed or lined with Spanish cedar, and the lid 28 forms a precision tight seal with the box 26 when the lid is in its closed position (FIG. 3). As shown in FIG. 4, the inner surface of the lid 28 supports a humidifier 32 and sometimes a humidistat 34. When the lid 28 is closed, the humidifier 32 is capable of maintaining within the box 26 a relative humidity within a predetermined range between 65% and 75% and preferably about 70%. As mentioned above, one source for a humidifier 32 is the CREDO humidifier made by Credo in Marseilles, France. The humidistat 34 provides a reading or indication of the relative humidity within the humidor 25 and should be read immediately after the lid 28 is opened.

Figure 2:
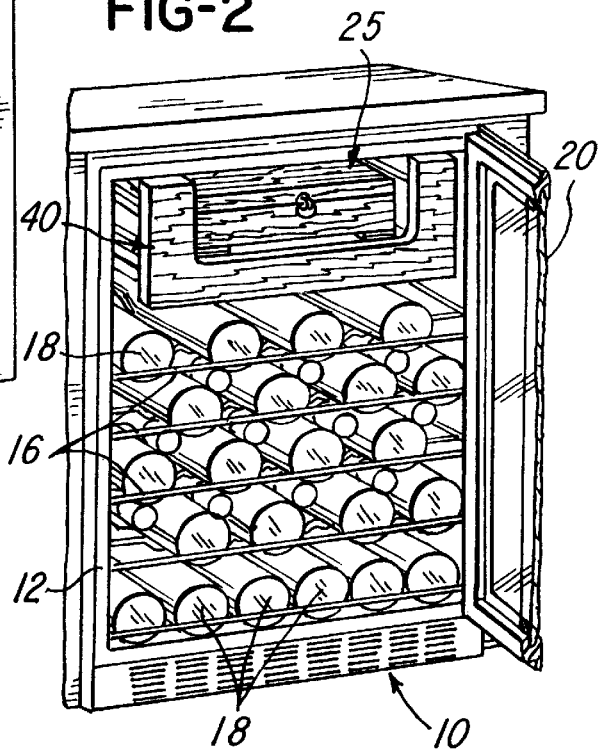
FIG. 2 is a perspective view of the refrigerator shown in FIG. I and with the access door open.
Figure 3:
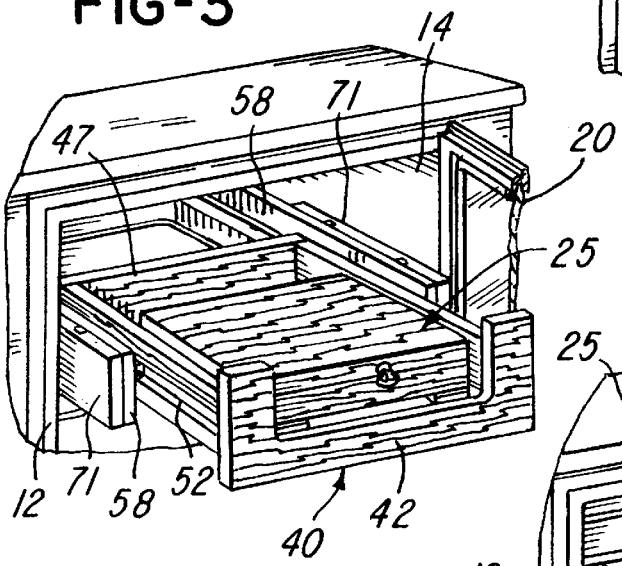
FIG. 3 is a fragmentary perspective view of the drawer and cigar humidor in their extended position.
Figure 4:
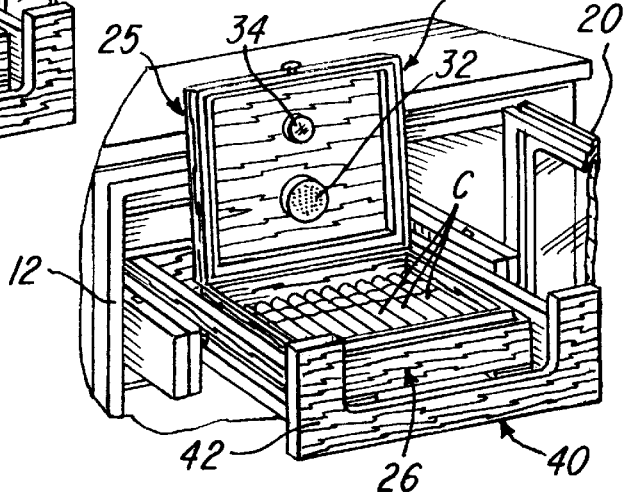
FIG. 4 is a fragmentary perspective view similar to FIG. 3 and showing the cigar humidor in its open position.
Figure 5:
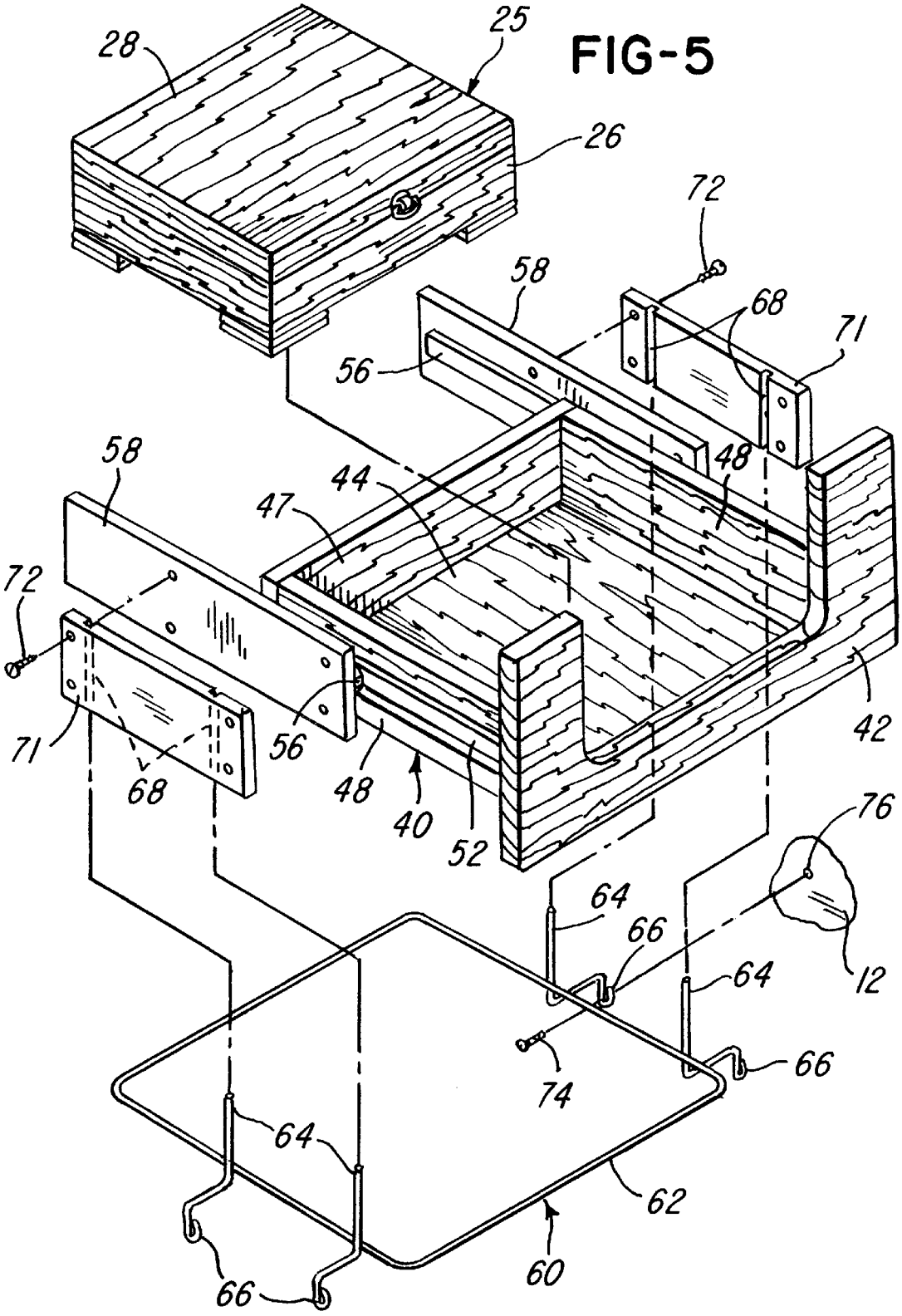
FIG. 5 is an exploded perspective view of the drawer and humidor shown in FIGS. 3 & 4 and the drawer support means.
Figure 6:
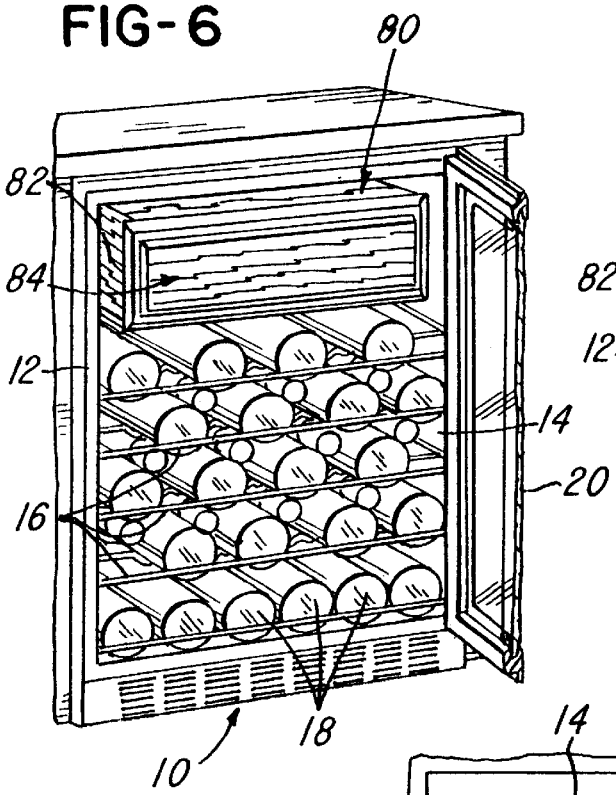
FIG. 6 is a perspective view similar to FIG. 2 and illustrating an extendable cigar humidor constructed in accordance with a modification of the invention.

Referring to FIGS. 2–5, the humidor 25 is supported within the upper portion of the chamber 14 of the wine bottle refrigerator 10 by means of an extendable shelf or drawer 40 which is moveable between a retracted position (FIG. 2)

within the chamber 14 and an extended position (FIG. 3) after the cabinet door 20 is moved to its open position. The drawer 40 is preferably constructed of wood and includes a U-shaped front panel 42 secured to a bottom panel 44 and a rectangular frame formed by a rear panel 47 and opposite side panels 48 rigidly secured to the bottom panel 44. A pair of extendable channel-shaped metal tracks 52 are secured to the side panels 48 and receive a corresponding pair of guide rails or rollers 56 secured to a pair of corresponding side support members 58.

The support members 58 are positioned within the cabinet chamber 14 by a metal wire frame 60 (FIG. 5) which includes a formed rectangular wire base 62 welded to four L-shaped legs 64 each having a bottom eyelet or loop portion 66. The vertical portions of the legs 64 are captured in corresponding slots 68 formed within a pair of side panels 71 each of which is secured by a set of screws 72 to the corresponding support member 58. The frame 60 is mounted within the refrigerator chamber 14 by a set of four screws 74 (FIG. 5) which extend through the loop portions 66 and are threaded into corresponding holes 76 within the opposite side walls of the cabinet 12. The wire legs 64 of the frame 60 support the members 58 which, in turn, support the tracks 52 of the drawer 40 for movement of the drawer between its retracted position within the chamber 14 and its extended position (FIG. 3) projecting outwardly from the front opening of the chamber 14.

Figure 7:
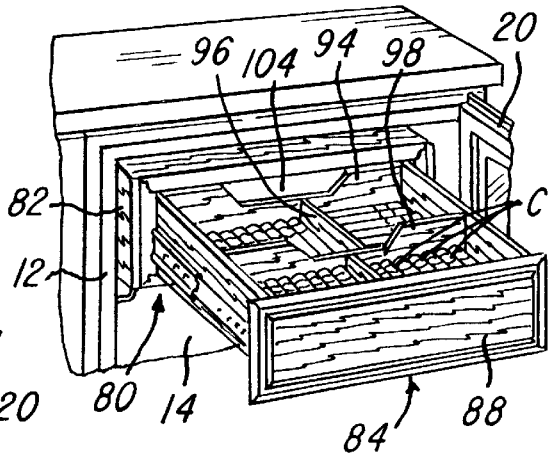
FIG. 7 is a fragmentary perspective view similar to FIG. 4 and showing the extended drawer portion of the humidor shown in FIG. 6.
Figure 8:
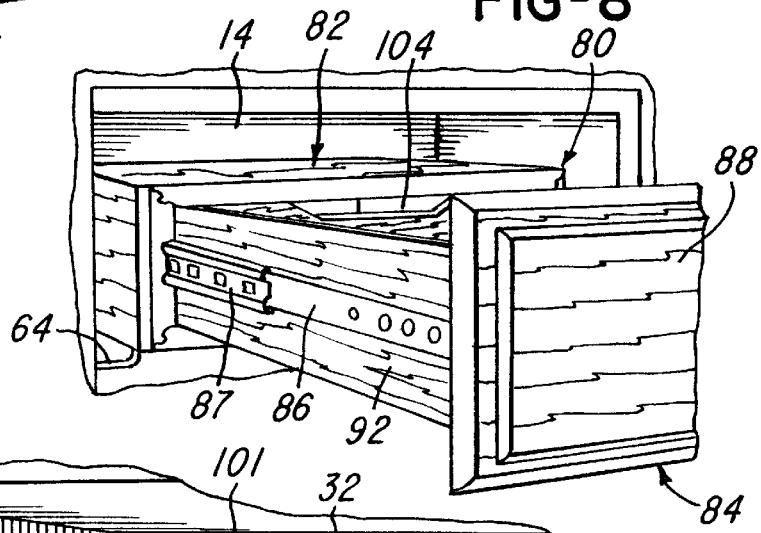
FIG. 8 is an enlarged fragmentary perspective view of the extended humidor drawer shown in FIG. 7.

Referring to FIGS. 6–9 which illustrate another embodiment of the invention, a cigar humidor 80 includes a rectangular wood box 82 having a front opening which receives a wood drawer 84. The drawer is supported by a pair of full extension telescopic metal tracks 86 and 87 for movement between a retracted closed position (FIG. 6) and an extended open position (FIG. 7 & 8). The humidor box 82 is supported within the upper portion of the refrigerator chamber 14 by the frame 60, and the legs 64 project upwardly into corresponding holes or slots within the side walls of the wood box 82 which rests on the rectangular wire frame 62. The drawer 84 of the humidor 80 has a front closure panel 88 which is secured to parallel side panels 92, a bottom panel (not shown) and a rear panel 94.

Figure 9:
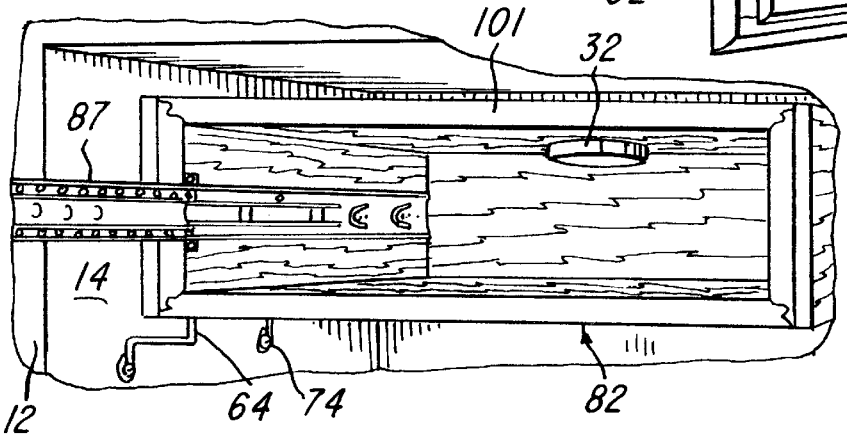
FIG. 9 is a fragmentary perspective view of the humidor box shown in FIG. 6–8 and with the humidor drawer removed.

Preferably, the box 82 and drawer 84 of the humidor 80 are constructed or lined of Spanish cedar, and adjustable wood partitions 96 and 98 of Spanish cedar are positioned within the drawer 84 according to the lengths of the cigars C. As shown in FIG. 9, a humidifier 32 is mounted on the top panel or wall 101 of the box 82 and provides the desired percentage of relative humidity, preferably about 70%, within the humidor 80 when it is closed. As shown in FIG. 7, the rear wall or panel 94 of the drawer 84 has a top recess 104 to provide clearance for the humidifier 32 when the drawer 84 is moved between its closed and open positions.

From the drawings and the above description, it is apparent that a wine bottle refrigerator incorporating a cigar humidor constructed and supported in accordance with the invention, provides desirable features and advantages. For example, the drawer 40 or 84 is supported within the upper portion of the refrigerator chamber 14 to provide for quick and convenient access to the humidor 25 or 80 for loading or removing cigars. In addition, the wine bottle refrigerator 10 provides for storing the humidors in a controlled and dependable environment of substantially constant temperature and humidity which preserves and extends the life of the cigars since the cigars are maintained within a substantially constant desired temperature range and at a desired relative humidity. The extendable drawer 40 and the box 82 may also be easily installed in the wine bottle refrigerator 10 by simply mounting the wire frame 60 on the cabinet in place of a wine bottle rack 16.

While the cigar humidors and their support within a wine bottle refrigerator as herein described, constitute preferred embodiments of the invention, it is to be understood that the invention is not limited to the precise structure described, and that changes may be made therein without departing from the scope and spirit of the invention as defined in the appended claims.

What is claimed is:

1. In a wine bottle refrigerator including a cabinet defining a controlled chamber maintained within predetermined ranges of temperature and relative humidity, said cabinet having a front opening normally closed by a door pivotable between an open position and a closed position, a set of racks within said chamber for supporting bottles of wine, a cigar humidor within said chamber and comprising a box and a closure moveable between an open position and a closed position, said box and closure defining an enclosed compartment for confining a supply of cigars, a humidifier within said compartment for maintaining the cigars generally at a predetermined relative humidity, and an extendable support within said chamber and supporting at least a portion of said humidor and the cigars for movement between a retracted stored position within said controlled chamber and an extended access position forwardly of said front opening after said door is pivoted to said open position.

2. A wine bottle refrigerator as defined in claim 1 wherein said extendable support comprises a pair of parallel spaced horizontal extension tracks disposed within said chamber.

3. A wine bottle refrigerator as defined in claim 2 wherein said support comprises a drawer supported by said extension tracks.

4. A wine bottle refrigerator as defined in claim 3 wherein said humidor is removable from said drawer.

5. A wine bottle refrigerator as defined in claim 2 wherein said closure of said humidor comprises a drawer supported within said box by said extension tracks.

6. A wine bottle refrigerator as defined in claim 1 wherein said support comprises a wire frame including a set of legs secured to said cabinet.

7. In a wine bottle refrigerator including a cabinet defining a controlled chamber maintained within predetermined ranges of temperature and relative humidity, said cabinet having a front opening normally closed by a door pivotable between an open position and a closed position, a set of racks within said chamber for supporting bottles of wine, a cigar humidor within said chamber and comprising a wood box and a wood closure moveable between an open position and a closed position, said box and closure defining an enclosed compartment for confining a supply of cigars, a humidifier within said compartment for maintaining the cigars generally at a predetermined relative humidity, and a pair of parallel spaced horizontal extension tracks mounted within said chamber and supporting at least a portion of said humidor and the cigars for movement between a retracted stored position within said controlled chamber and an extended access position forwardly of said front opening after said door is pivoted to said open position.

8. A wine bottle refrigerator as defined in claim 7 and including a drawer supported within said chamber by said extension tracks.

9. A wine bottle refrigerator as defined in claim 8 wherein said humidor is removable from said drawer.

10. A wine bottle refrigerator as defined in claim 7 wherein said closure of said humidor comprises a drawer supported within said box by said extension tracks.

11. A method of storing cigars within predetermined ranges of temperature and relative humidity, comprising the steps of enclosing the cigars within a humidor including a box and a closure moveable between an open position and a closed position, positioning a humidifier within the humidor to maintain the cigars generally within a predetermined range of relative humidity, supporting the humidor and the enclosed cigars for movement within a controlled chamber of a wine bottle refrigerator enclosing racks supporting bottles of wine, and maintaining the controlled chamber and the humidor within predetermined ranges of temperature and relative humidity.

12. A method as defined in claim 11 wherein the controlled chamber and the humidor are maintained within a temperature range of between 50° F. and 75° F.

* * * * *